United States Patent [19]

Hepp

[11] Patent Number: 5,048,211

[45] Date of Patent: Sep. 17, 1991

[54] SAFETY LOCK FOR FIREARMS

[76] Inventor: Norbert Hepp, 3871 Foskett Rd., Medina, Ohio 44256

[21] Appl. No.: 607,809

[22] Filed: Nov. 1, 1990

[51] Int. Cl.[5] ..... F41A 17/44

[52] U.S. Cl. ..... 42/70.11

[58] Field of Search ..... 42/70.11, 96; 138/89

[56] References Cited

U.S. PATENT DOCUMENTS

| | | | |
|---|---|---|---|
| 2,836,918 | 6/1958 | Pula et al. | 42/70.11 |
| 2,923,323 | 2/1960 | Franck | 42/70.11 |
| 2,937,666 | 5/1960 | Maisch | 42/70.11 |
| 3,154,874 | 11/1964 | Stewart | 42/70.11 |
| 3,193,959 | 7/1965 | Jaycox | 42/70.11 |
| 4,600,036 | 7/1986 | Noe | 138/89 |

FOREIGN PATENT DOCUMENTS

| | | | |
|---|---|---|---|
| 2158924 | 11/1985 | United Kingdom | 42/70.11 |

*Primary Examiner*—Michael J. Carone

*Attorney, Agent, or Firm*—Renner, Kenner, Greive, Bobak, Taylor & Weber

[57] ABSTRACT

A chamber and bore lock for a firearm includes a rod adapted for receipt within the barrel bore of the firearm. One end of the rod has a fixed plug with an abutting O-ring. A pair of sleeves are received upon the rod with an O-ring therebetween. A threaded cap engages an end of the rod at the muzzle of the firearm, such that threaded movement of the cap draws the plug toward the cap, urging the sleeves into compressing and radially deforming engagement with the O-rings which engage inner circumferential surfaces of the barrel bore and firing chamber of the firearm.

18 Claims, 3 Drawing Sheets

SAFETY LOCK FOR FIREARMS

TECHNICAL FIELD

The invention herein resides in the art of safety devices and, more particularly, to such devices for implementation with firearms. Specifically, the invention relates to a device for securing the firing chamber and barrel bore of a firearm, preventing the same from receiving and discharging a shell.

BACKGROUND ART

Ownership of firearms is not only commonplace, but a right secured by the Constitution. Firearms are commonly used for sports such as target, skeet, and trap shooting, as well as the hunting of wild animals. Of course, firearms are also owned by many households as means of protection or security. Irrespective of the reason, a large percentage of households have firearms therein, giving rise to safety considerations when children are present, or when the firearms are handled. While some safety problems can be remedied by simply storing firearms away from ready access, such often defeats the purpose of having the firearms for protection or security reasons. Additionally, the storing of firearms away from ready access often precludes the ability to display the firearms on the wall, in an open case, or the like.

The prior art has taught a partial dismantling and separate storage of component parts of the firearm to prevent wrongful access. For example, the clip, magazine, "bolt," and/or ammunition can be stored separate and apart from the firearm, substantially precluding the likelihood that a loaded firearm could be wrongfully accessed or improperly handled. However, this technique substantially destroys the utility of the firearm as a protective device, and precludes legitimate handling of the firearm as a complete unit.

Other approaches to securing firearms have often included the chaining or otherwise affixing of the firearm to an immobile object. The requisite chains and securing devices are generally unattractive, making the same undesirable for securement of the firearm intended for display.

Still further, the prior art has taught the implementation of trigger locks to secure the trigger of the firearm, preventing use of the trigger. Again, this type of structure renders the firearm unattractive, adding a substantial structure to the firearm which can be seen as being obviously unintended for the firearm in its useful state.

The prior art techniques for securing firearms have typically allowed the firing chamber of the firearms to receive live shells or ammunition. Such presents a most dangerous situation. Even though the trigger of the firearm might be secured, dropping of the firearm with a shell in the firing chamber can result in an accidental discharge and serious injury or death to bystanders. Indeed, none of the prior art techniques for securing firearms provide a device for obstructing the firing chamber and/or bore of the barrel of the weapon. Indeed, no known systems provide a securing means which also provides a means for sealing the chamber and bore from the environment, preventing corrosion, rust, or the like from entering these portions of the weapon, while also keeping the firearm in a properly lubricated state.

DISCLOSURE OF INVENTION

In light of the foregoing, it is a first aspect of the invention to provide a safety lock for firearms which secures the firing chamber of the firearm.

Another aspect of the invention is to provide a safety lock for firearms which secures the bore of the barrel of the firearm.

Still a further aspect of the invention is the provision of a safety lock for firearms which is attractive, and not obtrusive to the appearance of the firearm.

Yet another aspect of the invention is the provision of a safety lock for firearms which provides a means for securing and sealing the bore and firing chamber of the firearm from the environment.

The foregoing and other aspects of the invention which will become apparent as the detailed description proceeds are achieved by a safety mechanism for receipt within the bore of a barrel of a firearm, comprising: a rod having a first and second ends; a sleeve received upon said rod; and means received upon said rod for radially expanding into securing engagement with the bore in response to axial movement of said sleeve upon said rod.

Still a further aspect of the invention is attained by a safety device for securing a firearm, comprising: a rod, threaded at a first end thereof and having a plug fixed to a second end thereof; a sleeve slidingly received upon said rod; a first expandable ring received upon said rod; and a head threadedly received upon said second end of said rod, threaded movement of said head and rod urging said sleeve into compressing engagement with said expandable ring, deforming said ring into radial contacting engagement with a bore of the firearm.

DESCRIPTION OF DRAWINGS

For a complete understanding of the objects, techniques and structure of the invention reference should be made to the following detailed description and accompanying drawings wherein.

BEST MODE FOR CARRYING OUT THE INVENTION

Figure 1:
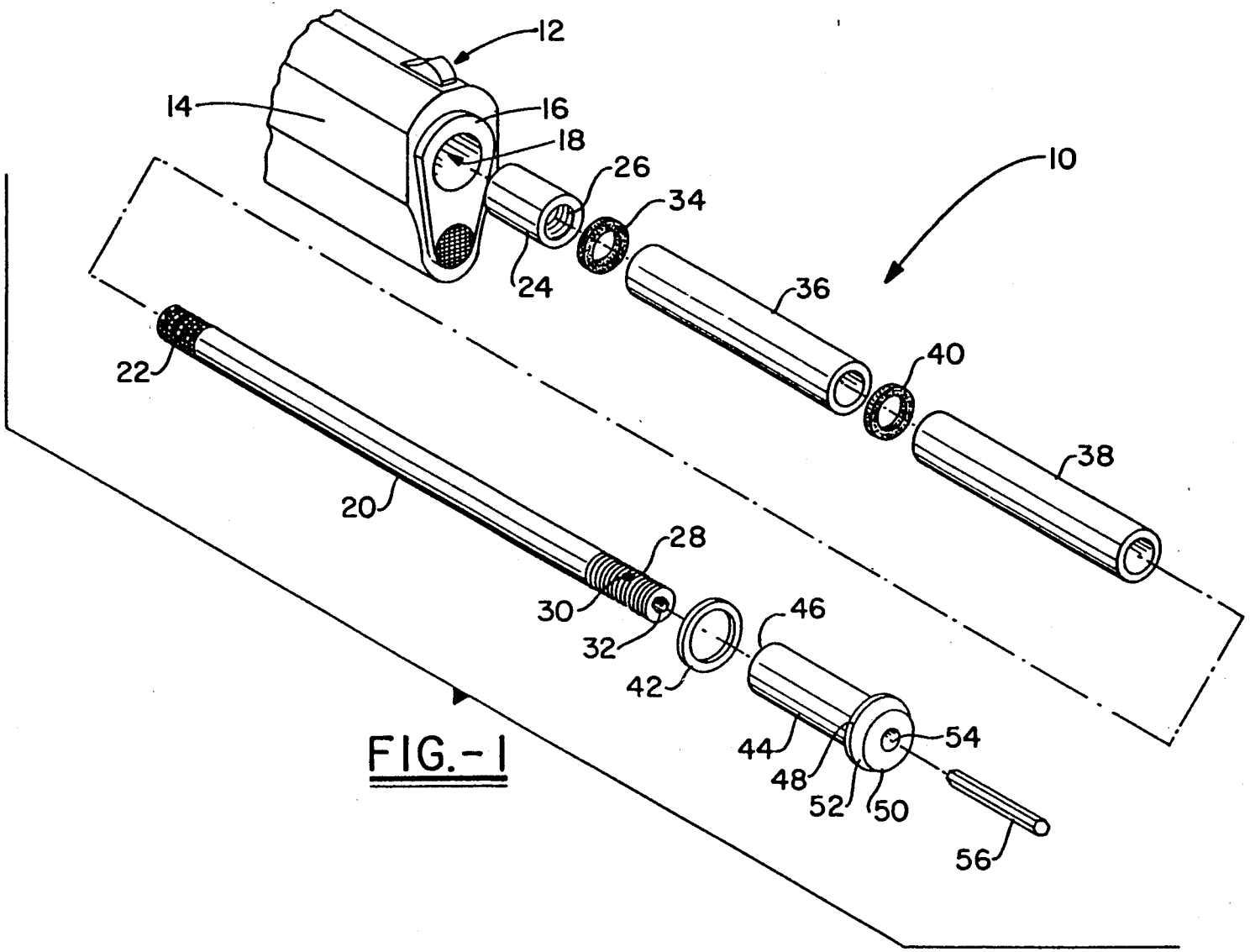
FIG. 1 is an assembly diagram of the safety lock mechanism of the invention.

Referring now to the drawings and more particularly FIG. 1, it can be seen that a firearm safety device according to the invention is designated generally by the numeral 10. As will become apparent herein, the structure 10 is intended to serve as a firing chamber lock mechanism, securing the barrel and firing chamber of the firearm with which it is employed. The mechanism 10 shown in the assembly drawing of FIG. 1 for a firearm 12, having a barrel 14 extending to a muzzle 16. A bore 18 extends axially into the barrel 14 from the muzzle 16 in standard fashion. As will become further apparent herein, the bore 18 typically terminates at a firing chamber of the firearm.

The mechanism 10 includes a pull rod 20, knurled at one end 22 to securedly receive the bore 26 of and end plug 24. An appropriate epoxy, cement, or other permanent adhesive is interposed between the knurled surface of the end 22 and the inner surfaces of the bore 26 to assure secure bonding therebetween. In a preferred embodiment of the invention, the end plug 24 may be simply machined from the same stock as the pull rod 20, such that the plug 24 simply comprises an enlarged integral portion at the end of such rod.

As shown, the pull rod 20 is threaded at the end 28 opposite that of the end plug 24. A nylon locking insert 30 is interposed within the threads 28, extending radially therefrom. As will be appreciated by those skilled in the art, the nylon lining insert 30 provides a means for securing a member threaded onto the threads 28, greatly limiting or restricting any tendency to disengage or unthread. A key slot or bore 32 axially traverses a portion of the rod 20 from the end surface thereof having the threads 28 thereon, as shown. In a preferred embodiment of the invention, the key slot or bore 32 is of unique configuration in cross section, adapted to receive or mate with a specific key in a manner to be discussed below.

An O-ring 34 of rubber or other elastomeric or resilient material is received upon the rod 20 abutting against the outer face ring of the end plug 24. A pair of tubular sleeves 36, 38 are received upon the rod 20 with an O-ring 40, similar to the O-ring 34, interposed therebetween.

An O-ring seal or flat washer 42, having an outer diameter greater than the diameter of the bore 18, is received upon a cap 44 having a threaded bore 46 axially therein to mate with the threaded end 28 of the rod 20. The cap 44 extends to a radially extending flange or shoulder 48 which carries a head 50 having a chamfered outer circumference 52, as shown. A bore 54 extends axially through the head 50 and cap 54 into the threaded bore 46. The bore 46 is axially aligned with the key slot or bore 32 in the threaded end of the rod 20. Accordingly, the bore 46 provides a means to receive the key 56 for mating engagement with the key slot 32 for operation to be discussed below. As presented earlier, it will be appreciated that the key 56 and slot 32 are of unique, but mating cross sections, such that a standard tool or design would not be capable of making entry and engagement with the slot 32.

Figure 2:
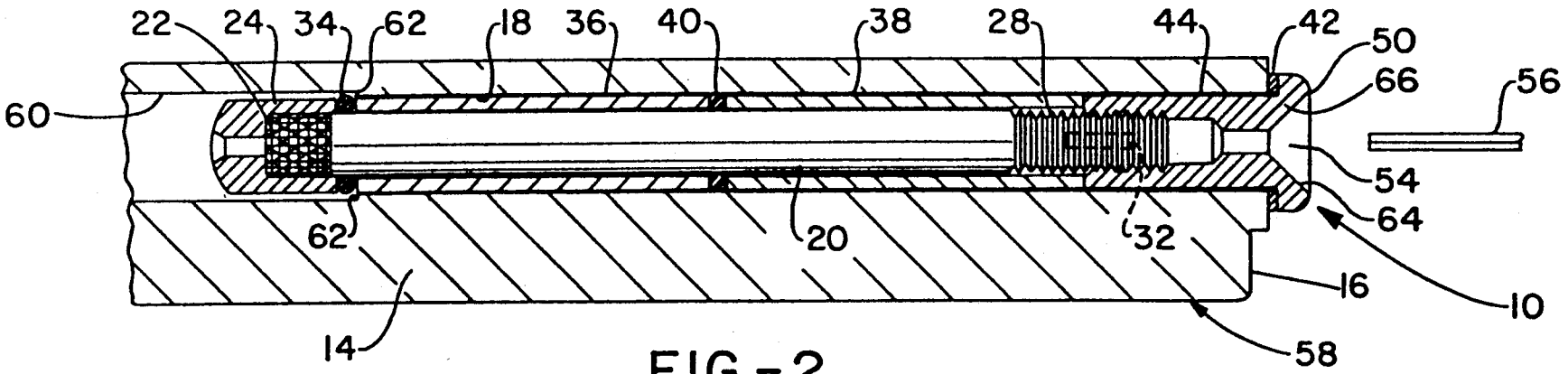
FIG. 2 is a side sectional view of a safety lock mechanism according to the invention as intended for use with semi-automatic handguns.

The implementation of the lock mechanism 10 in a semiautomatic hand gun 58 can be seen with reference to FIG. 2. As shown, the O-ring 34 is brought into engagement with the plug 24 over the rod 20. The sleeve 36 is placed over the rod 20, followed by placement of the O-ring 40. Subsequently, the sleeve 38 is placed over the rod 20 and the assembly is inserted into the bore 18 of the barrel 14. It will be appreciated that the outside diameters of the plug 24, sleeves 36, 38, and O-rings 34, 40 are such as to be received within the bore 18, with a slight clearance therebetween. In a preferred embodiment of the invention, the O-rings 34, 40 have an outside diameter substantially equal to, but slightly less than, the inside diameter of the bore 18. The non-resilient material such as the plug 24 and sleeves 36, 38 are of a lesser diameter.

The assembly just described is inserted into the depth of the bore 18 such that the plug 24 and O-ring 34 are received within the firing chamber 60 of the gun 58. It will be appreciated by those skilled in the art that the firing chamber 60 has a slightly greater diameter than the bore 18, the departure between the firing chamber 60 and bore 18 being defined by the shoulder 62, adapted for contacting and engaging the rim of a shell. With the assembly so positioned, the washer or seal 42 is slid over the body of the cap 44 and into engagement with the shoulder 48. The body of the cap 44 is then slid into the bore 18 at the muzzle 16 such that the threaded bore 46 makes engagement with the threaded end 28 of the rod 20. Hand tightening can be attained by the user gripping and rotating the head 50 upon the rod 20. At a point, however, the key 56 is passed through the bore 54 and into engagement with the key slot 32. Further tightening rotational movement of the rod 20 is then undertaken by the key 56. During this operation, the head 50 and cap 44 are restrained from rotating by finger pressure.

As the rod 20 is rotated such that the cap 44 and threaded end 28 make tightening engagement, the axial movement of the cap 44 upon the rod 20 urges the sleeves 38, 36 toward the fixed plug 24. At a point, this axial movement of the sleeve upon the rod 20 compressively engages the O-rings 34, 40, causing the same to extrude or deform radially outwardly into engagement with the respective inner circumferential surfaces of the firing chamber 60 and bore 18. The length and structure of the assembly 10 is such that the expanded O-ring 34 lodges within the firing chamber 60 and is prevented from removement therefrom not only by such radial engagement, but also by means of lateral engagement with the shoulder 62, should any force be placed upon the rod 20 to move it axially from the bore 18. The O-ring 40 makes similar radial engagement with the inner circumferential surface of the bore 18 about midway along the barrel. Finally, the seal 42 is urged against the face of the muzzle 16 and the shoulder 48 of the cap 44. Accordingly, the bore and firing chamber are sealed, and fully occupied so that a shell cannot enter either the firing chamber or the bore.

With continued reference to FIG. 2, it can further be seen that an inner tapered bore or chamfer 64 extends from the outer surface of the head 50 to the bore 54. The chamfering of the bore 64 leaves only a thin web of material 66 between the chamfer 64 and the inner most circumference of the shoulder 48. Accordingly, this web of material 66 is weaker than any other part of the assembly 10. Should one attempt to tamper with the securing device 10 by attempting to pry or pull the head 50, the head 50 will break at the webbing 66, preventing such extraction. Of course, the head may be designed without the chamfered or tapered bore, as the same is shown in FIG. 1.

Figure 3:
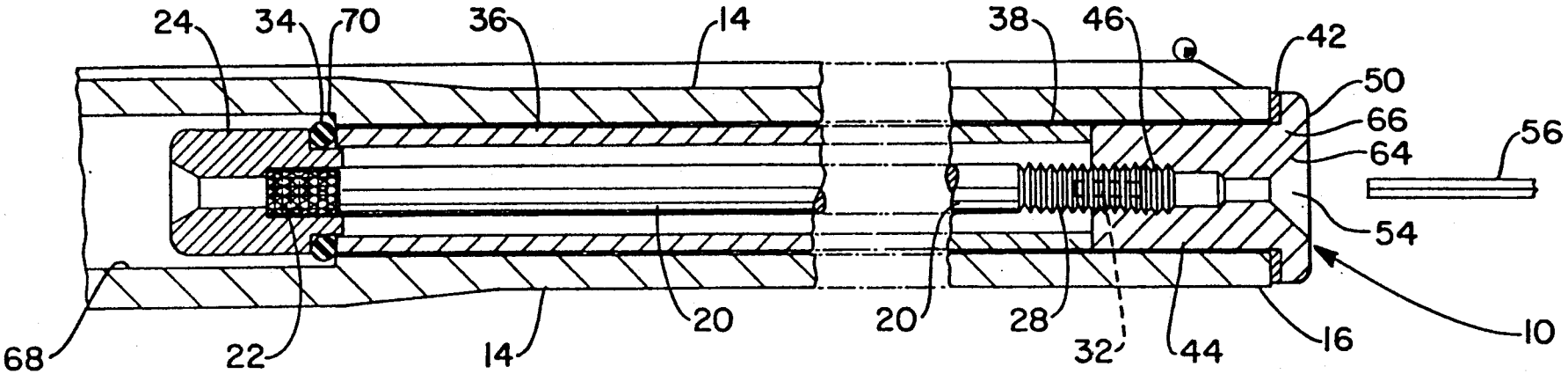
FIG. 3 is a side sectional view of a safety lock mechanism according to the invention as the same would be intended for use with a shotgun.

Referring now to FIG. 3, it can be seen that the assembly 10 presented above can be employed in a shotgun. In this embodiment, the firing chamber 68 has a shoulder 70 at the end thereof entering the bore 18 of the barrel 14. The plug 24 is again received within the firing chamber 68, with the O-ring 34 also being received therewithin for making radial engagement with the inner circumference of the firing chamber 68, and lateral engagement, if necessary, with the shoulder 70.

It will further be appreciated with respect to FIG. 3 that the inner rod 20 may be of substantially smaller diameter than the inner diameters of the sleeves 36, 38 when the securing device is used in association with a shotgun. Since the purpose of the pull rod 20 is simply to pull the elements of the lock mechanism 10 toward each other, effecting the distorting and securing engagement of the O-rings 34, 40 with the inner circumferential surfaces of the barrel bore 18, the rod 20 may be of significantly smaller diameter than the bore 18. However, the walls of the sleeves 26, 38 are desirably in close juxtaposition to the inner wall of the barrel bore, since it is these walls which make the distorting contacting engagement with the O-rings 34, 40.

Figure 4:
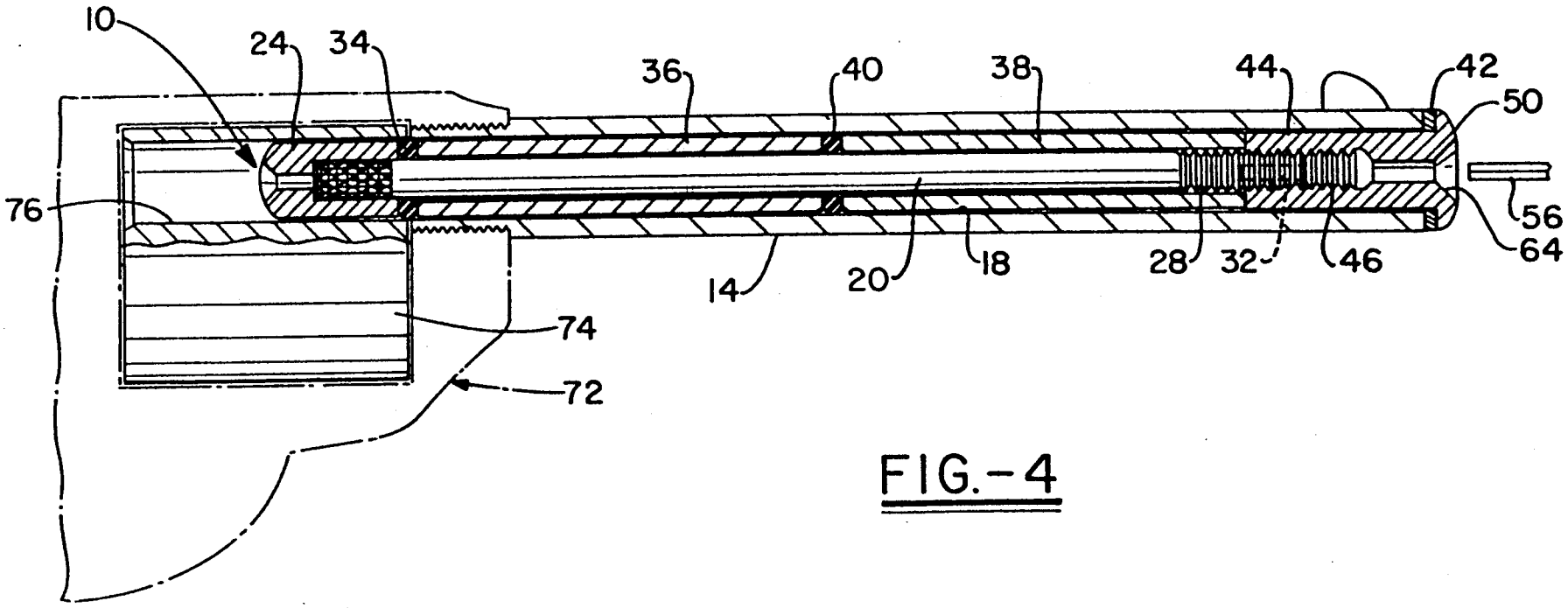
FIG. 4 is a side sectional view of a safety lock mechanism according to the invention intended for use with a revolver.

With reference now to FIG. 4, it can be seen that the concept of the invention may also be employed in association with a revolver handgun 72. Here, the lock mechanism 10 passes axially through the bore 18 of the barrel 14 such that the end plug 24 passes through the revolving cylinder 74 of the firearm and into an aligned bore 76 of the cylinder 74. Accordingly, with the lock 10 actuated in the manner presented above, not only must the cylinder bore 76 be devoid of a shell, but cylinder 74 is prevented from any rotational movement.

It will be readily appreciated by those skilled in the art that the materials employed for implementation in construction of the invention can vary. In a preferred embodiment, the end plug 24, rod 20, and sleeves 36, 38 are of suitable metal construction such as steel, aluminum, or the like. In a preferred embodiment of the invention, the cap 44 and associated head 50 are of brass, providing an attractive appearance, while also being sufficiently weak at the web 66 to break away in the event that any tampering is attempted. It will further be appreciated that the lengths of the assemblies 10, as discussed above, are desirably tailored to particular firearms, such that the washer 42 is caused to seal against the muzzle 16 at the time that the O-rings 34, 40 have made their distorting radial sealing engagement. It will be apparent to those skilled in the art that the diameters and specific configurations of the sleeves, rods, and the like may be varied in keeping with the concept of the invention.

It should now be apparent that the structures presented above are capable of securing the bore and firing chamber of a firearm such that no shell or ammunition can populate those portions of the weapon. The securement is achieved in an attractive manner, with the only apparent difference between the firearm and one not so secured being the presence of an attractive brass head 50 at the muzzle end of the bore 18. It should also be appreciated that the sealing engagement of the washer 42 against the muzzle allows lubricating oil or other material to be swabbed into the bore 18 of the barrel 14 and to be retained therein without adverse affects from the environment during the storage period.

It will be readily appreciated by those skilled in the art that removal of the securing lock 10 follows the reverse procedure of its insertion. The key 56 may simply be placed through the bore 54 and into the key slot 32. Rotation of the rod 20 opposite that for tightening may then be undertaken, allowing the cap 44 to retract from the end of the rod 20. This movement allows the sleeves 36, 38 to release their compressive engagement against the O-rings 34, 40, releasing the radial engagement with the inner circumferential surface of the bore 18. The assembly 10 may then simply be retracted by pulling with one's fingers.

Thus it can be seen that the objects of the invention have been satisfied by the structure presented above. While in accordance with the patent statutes only the best mode and preferred embodiments of the invention have been presented and described in detail, it is to be understood that the invention is not limited thereto or thereby. Accordingly, for an appreciation of the true scope and breadth of the invention reference should be made to the following claims.

What is claimed is:

1. A safety mechanism for receipt within the bore of a barrel of a firearm, comprising:

a rod having first and second ends;

a sleeve received upon said rod;

means received upon said rod for radially expanding into securing contacting engagement with the bore in response to axial movement of said sleeve upon said rod, said means comprising a first O-ring interposed between a first end of said sleeve and said plug, said first O-ring radially expanding therebetween in response to axial movement of said sleeve upon said rod;

a plug fixed at said first end of said rod and a head threadedly received on said second end of said rod, said head engaging said sleeve; and wherein said plug is received within a firing chamber of the firearm, said first O-ring making securing engagement with the firing chamber.

2. The safety mechanism according to claim 1, wherein said sleeve is moved axially upon said rod by threaded engagement of said rod with said head.

3. The safety mechanism according to claim 2, wherein said head seals an end of the bore at a muzzle of the firearm.

4. The safety mechanism according to claim 3, wherein said sleeve comprises multiple sections, said means further comprising a second O-ring received between a pair of said sections and radially expanding into securing contacting engagement with the bore in response to said axial movement of said sleeve upon said rod.

5. The safety mechanism according to claim 4, wherein said plug is received within a firing chamber of the firearm, said first O-ring making securing engagement with the firing chamber.

6. The safety mechanism according to claim 4, wherein said plug is received within a bore of a cylinder of the firearm.

7. A safety device for securing a firearm, comprising:

a rod, threaded at a first end thereof and having a plug fixed to a second end thereof;

a sleeve slidingly received upon said rod;

a first expandable ring received upon said rod; and a head threadedly received upon said second end of said rod, threaded movement of said head and rod urging said sleeve into compressing engagement with said expandable ring, deforming said ring into radial contacting engagement with a bore of the firearm, said head having a chamfered recess centrally therein and a shoulder extending radially from the body portion, a thin web of weakened material extending between said chamfered recess and shoulder.

8. The safety device according to claim 7, wherein said head seals an end of the bore of the firearm at a muzzle of the firearm.

9. The safety device according to claim 7, wherein said head has an axial bore extending from said chamfered recess into communication with an axial key slot in said first end of said rod.

10. The safety device according to claim 7, wherein said first expandable ring is compressively engaged between said sleeve and said plug.

11. The safety device according to claim 10, wherein said sleeve comprises a plurality of sections, and further comprises a second expandable ring interposed between a pair of said sleeve sections, said second expandable ring radially expanding into contacting engagement with the bore of the firearm in response to said threaded movement of said head and rod.

12. The safety device according to claim 11, wherein said plug is received within a firing chamber of the firearm.

13. The safety device according to claim 12, wherein said first expandable ring engages a shoulder of the firing chamber.

14. The safety device according to claim 11, wherein said plug is received within a bore of a cylinder of the firearm.

15. The safety device according to claim 11, wherein said threaded end of said rod has a locking insert therein for locking engagement with said head.

16. A safety device for securing a firearm, comprising:

a rod, threaded at a first end thereof and having a plug fixed to a second end thereof, said plug being received in a firing chamber of the firearm;

a sleeve slidingly received upon said rod;

a first expandable ring received upon said rod and engaging a shoulder of the firing chamber, and a head threadedly received upon said second end of said rod, threaded movement of said head and rod urging said sleeve into compressing engagement with said expandable ring between said sleeve and said plug, deforming said ring into radial contacting engagement with a bore of the firearm.

17. A safety device for securing a firearm, comprising:

a rod, threaded at a first end thereof and having a plug fixed to a second end thereof, said plug being received within a bore of a cylinder of the firearm;

a sleeve slidingly received upon said rod;

a first expandable ring received upon said rod; and a head threadedly received upon said second end of said rod, threaded movement of said head and rod urging said sleeve into compressing engagement with said expandable ring, deforming said ring into radial contacting engagement with a bore of the firearm.

18. A safety device for securing a firearm, comprising:

a rod, threaded at a first end thereof and having a plug fixed to a second end thereof;

a sleeve slidingly received upon said rod;

a first expandable ring received upon said rod;

a head threadedly received upon said second end of said rod, threaded movement of said head and rod urging said sleeve into compressing engagement with said expandable ring, deforming said ring into radial contacting engagement with a bore of the firearm; and a locking insert within said threaded first end of said rod for locking engagement with said head.

* * * * *